US008628431B2

(12) United States Patent
Schweigert et al.

(10) Patent No.: US 8,628,431 B2
(45) **Date of Patent: *Jan. 14, 2014**

(54) GOLF CLUB HEADS WITH PROTRUSION WEIGHTS AND RELATED METHODS

(71) Applicant: Karsten Manufacturing Corporation, Phoenix, AZ (US)

(72) Inventors: Bradley D. Schweigert, Anthem, AZ (US); Michael R. Nicolette, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/737,386

(22) Filed: Jan. 9, 2013

(65) Prior Publication Data

US 2013/0123043 A1 May 16, 2013

Related U.S. Application Data

(63) Continuation of application No. 12/836,532, filed on Jul. 14, 2010, now Pat. No. 8,371,957.

(60) Provisional application No. 61/323,253, filed on Apr. 12, 2010, provisional application No. 61/328,613, filed on Apr. 27, 2010.

(51) Int. Cl.
*A63B 53/04* (2006.01)

(52) U.S. Cl.
USPC ..... 473/324; 473/334; 473/345; 473/349; 473/409

(58) Field of Classification Search
USPC ..... 473/324–350, 287–292, 256, 409; D21/733, 759
See application file for complete search history.

(56) References Cited

U.S. PATENT DOCUMENTS

| | | | |
|---|---|---|---|
| 1,946,208 | A | 2/1934 | Hampton |
| 1,993,928 | A | 3/1935 | Glover |
| 2,652,256 | A | 9/1953 | Thomas |
| 3,516,674 | A | 6/1970 | Scarborough |
| 4,811,950 | A | 3/1989 | Kobayashi |
| 5,078,400 | A | 1/1992 | Desbiolles et al. |
| 5,310,186 | A | 5/1994 | Karsten |

(Continued)

FOREIGN PATENT DOCUMENTS

| | | |
|---|---|---|
| CA | 2113701 | 7/1994 |
| CA | 2680337 | 9/2007 |

(Continued)

*Primary Examiner* — Sebastiano Passaniti

(57) ABSTRACT

A golf club head can comprise a head body and a protrusion weight coupled thereto. The protrusion weight can protrude from at least the heel portion of the head body. The head center of gravity of the golf club head can be defined by both a mass of the head body and a mass of the protrusion weight. The body center of gravity of the head body can be defined by the mass of the head body independent of the mass of the protrusion weight. A weight center of gravity of the protrusion weight can be defined by the mass of the protrusion weight independent of the mass of the head body, and can be external to a body volume of the head body. The protrusion weight can be at least partially visible from an exterior of the club head. Other embodiments and related methods are also disclosed herein.

20 Claims, 8 Drawing Sheets

(56) References Cited

U.S. PATENT DOCUMENTS

| | | | |
|---|---|---|---|
| 5,335,914 | A | 8/1994 | Long |
| 5,447,307 | A | 9/1995 | Antonious |
| 5,658,206 | A | 8/1997 | Antonious |
| D390,616 | S | 2/1998 | Maltby |
| 5,766,095 | A | 6/1998 | Antonious |
| 5,795,245 | A | 8/1998 | Chang et al. |
| D402,342 | S | 12/1998 | Antonious |
| 5,954,595 | A | 9/1999 | Antonious |
| 5,989,134 | A | 11/1999 | Antonious |
| 6,056,649 | A | 5/2000 | Imai |
| 6,074,310 | A | 6/2000 | Ota |
| 6,080,069 | A | 6/2000 | Long |
| 6,123,627 | A | 9/2000 | Antonious |
| D463,516 | S | 9/2002 | Antonious |
| 6,530,847 | B1 | 3/2003 | Antonious |
| 6,855,068 | B2 | 2/2005 | Antonious |
| 6,939,247 | B1 | 9/2005 | Schweigert et al. |
| 6,942,581 | B2 | 9/2005 | Kim et al. |
| 6,988,960 | B2 | 1/2006 | Mahaffey et al. |
| 7,169,060 | B2 | 1/2007 | Stevens et al. |
| 7,326,472 | B2 | 2/2008 | Shimazaki et al. |
| 7,503,854 | B2 | 3/2009 | Galloway et al. |
| 7,594,865 | B2 | 9/2009 | Ines |
| 7,648,425 | B2 | 1/2010 | Wahl et al. |
| D618,747 | S | 6/2010 | Schweigert et al. |
| D618,754 | S | 6/2010 | Schweigert et al. |
| 8,371,957 | B2 * | 2/2013 | Schweigert et al. ..... 473/324 |
| 2003/0228931 | A1 | 12/2003 | Antonious |
| 2005/0137024 | A1 | 6/2005 | Stites et al. |
| 2006/0100028 | A1 | 5/2006 | Kuo |
| 2006/0122004 | A1 | 6/2006 | Chen et al. |
| 2006/0178228 | A1 | 8/2006 | DiMarco |
| 2006/0199662 | A1 | 9/2006 | Cole |
| 2007/0265108 | A1 | 11/2007 | Lin et al. |
| 2007/0293333 | A1 | 12/2007 | Gwon |
| 2008/0009367 | A1 | 1/2008 | Johnson |
| 2009/0149276 | A1 | 6/2009 | Golden et al. |
| 2009/0275419 | A1 | 11/2009 | Cackett et al. |
| 2010/0016098 | A1 | 1/2010 | Tavares et al. |
| 2010/0184527 | A1 | 7/2010 | Demkowski et al. |

FOREIGN PATENT DOCUMENTS

| | | |
|---|---|---|
| EP | 1955740 | 8/2008 |
| GB | 2433210 | 6/2007 |
| WO | WO2007101350 | 9/2007 |

* cited by examiner

100

100

GOLF CLUB HEADS WITH PROTRUSION WEIGHTS AND RELATED METHODS

CROSS-REFERENCE TO RELATED APPLICATIONS

This patent application is a continuation of U.S. patent application Ser. No. 12/836,532, filed on Jul. 14, 2010, which claims priority to U.S. Provisional Patent Application No. 61/323,253, filed on Apr. 12, 2010, and to U.S. Provisional Patent Application No. 61/328,613, filed on Apr. 27, 2010. The disclosures of the referenced applications are incorporated herein by reference.

TECHNICAL FIELD

This disclosure relates generally to sports equipment, and relates more particularly to club heads and related methods.

BACKGROUND

Golf clubs and specifically golf club heads of various designs have typically been developed to improve the functionality of a person's golf swing and resulting golf shot. In particular, many people have a propensity to hit shots that tend to fade or slice, and/or they tend to hit the ball non-squarely, e.g., with a slightly open club face. Golf club manufactures have attempted to counteract such tendencies.

A golf club head's design may optimize the golf club head's weighting scheme by, for example, adjusting a center of gravity and/or moment of inertia of the golf club head. Such designs may mitigate a person's problems with golf swing inconsistencies. Prior attempts at optimizing golf club head's weighting scheme, however, have been limited by the golf club head's shape and volume. Therefore, a need exists in the art to develop golf club heads and related methods that address such limitations of the current technology.

BRIEF DESCRIPTION OF THE DRAWINGS

The invention will be better understood from a reading of the following detailed description of examples of embodiments, taken in conjunction with the accompanying figures.

Figure 1:
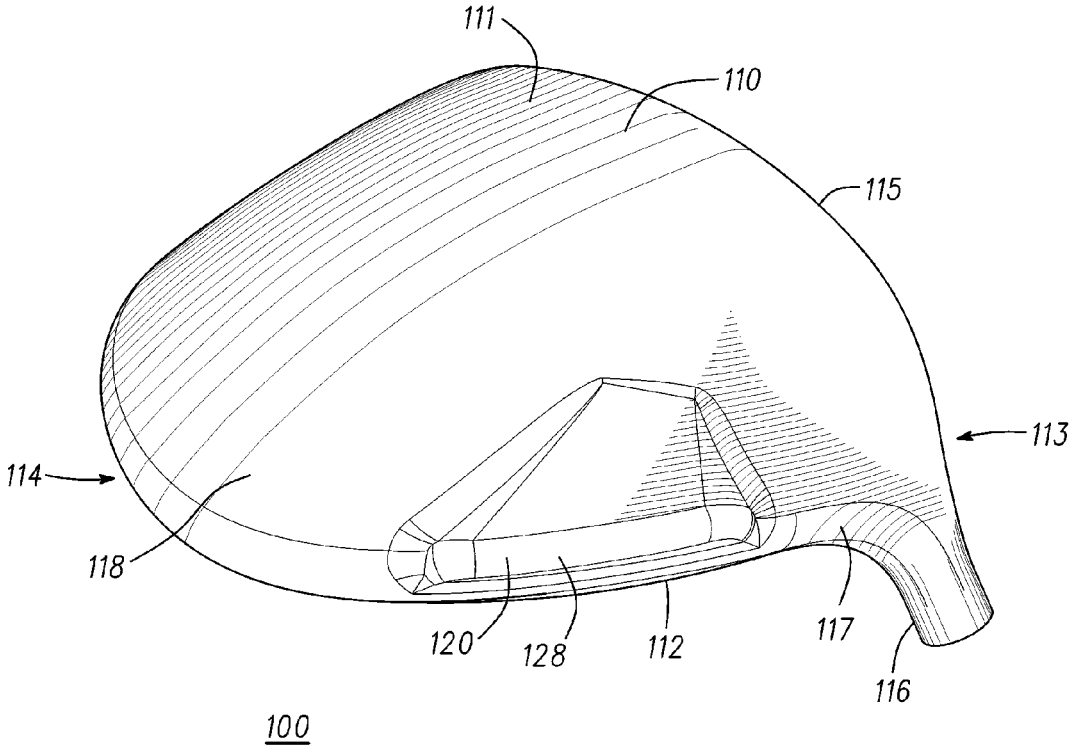
FIG. 1 illustrates a rear-heel perspective view of a golf club head comprising a protruding weight in accordance with an embodiment of the present disclosure.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, mechanically or otherwise. Two or more mechanical elements may be mechanically coupled, but not otherwise coupled. Coupling (whether mechanical or otherwise) may be for any length of time, e.g., permanent or semi-permanent or only for an instant. "Mechanical coupling" and the like should be broadly understood and include mechanical coupling of all types. The absence of the word "removably," "removable," and the like near the word "coupled," and the like does not mean that the coupling, etc. in question is or is not removable.

DESCRIPTION

In one embodiment, golf club head can comprise a body comprising a crown portion, a heel portion, a toe portion, a rear portion, a front portion, a geometric center, and at least one of a hosel portion, a sole portion, or a skirt portion. The golf club head can also comprise a protrusion weight protruded from the heel portion and from at least one of the sole portion or the skirt portion of the body. A center of gravity of the protrusion weight can be external to a body volume of the body of the club head. A moment of inertia of the club head can be increased due to a distance extension of a distance between the center of gravity of the protrusion weight and a center of gravity of the club head, the distance extension being external to the body volume. The center of gravity of the club head can be located at the heel portion of the body, shifted by the protrusion weight away from the toe portion and away from a center of gravity of the body. The protrusion weight can be at least partially visible from an exterior of the club head.

In one embodiment, a method for providing a golf club head can comprise providing a body of the golf club head, and providing a protrusion weight protruding from the body of the golf club head. Providing the body of the golf club head can comprise providing a crown portion, a toe portion, a heel portion, and at least one of a hosel portion, a sole portion, or a skirt portion. Providing the protrusion weight can comprise providing the protrusion weight to protrude from the heel portion and from at least one of the sole portion or the skirt portion. Providing the protrusion weight can also comprise providing a center of gravity of the protrusion weight to be external to the body of the golf club head, providing the protrusion weight to be at least partially visible from an exterior of the body, locating a center of gravity of the golf club head at the heel portion, shifted by the protrusion weight away from a center of gravity of the body and away from a geometric center of the body, and/or providing a moment of inertia of the golf club head to be increased due to a distance extension of a distance between the center of gravity of the protrusion weight and the center of gravity of the golf club head, the distance extension being external to a volume of the body.

In one embodiment, a golf club head can comprise a club head body comprising a crown portion, a club face, a heel portion, a toe portion, and at least one of a hosel portion, a sole portion, or a skirt portion. The golf club head can also comprise a protrusion weight protruded from the heel portion and from at least one of the sole portion or the skirt portion of the club head body. The protrusion weight can be at least partially visible from an address position viewpoint and can be at least partially external to the club head body. A center of gravity of the protrusion weight can be external to a contour of the club head body. A center of gravity of the club head can be located at the heel portion of the club head body, shifted by the protrusion weight away from the toe portion and away from a geometric center of the club head body. A moment of inertia of the club head can be increased due to a distance extension of a distance between the center of gravity of the protrusion weight and a center of gravity of the club head body, the distance extension being external to a volume of the club head body. The body of the club head can comprise a compass plane defined by a heel-to-toe axis extending through the geometric center, and by a front-to-rear axis extending through the geometric center. At the address position, a toe-end of the heel-to-toe axis can be at zero degrees with respect to the compass plane, and the center of gravity of the protrusion weight can be located between approximately 120 degrees and approximately 180 degrees with respect to the compass plane.

Other examples and embodiments are further disclosed herein. Such examples and embodiments may be found in the figures, in the claims, and/or in the description of the present application.

Figure 2:
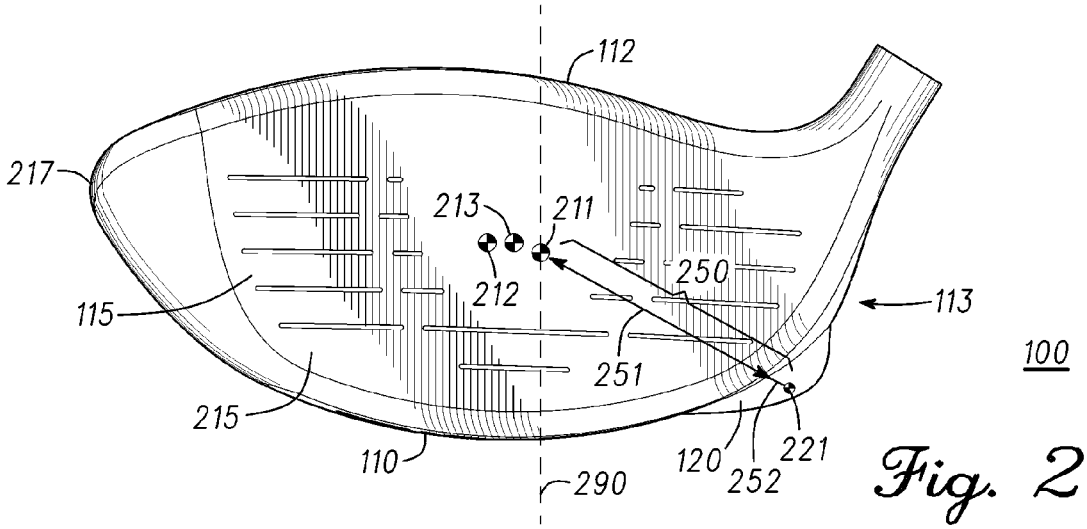
FIG. 2 illustrates a view of a front portion of the golf club head of FIG. 1.
Figure 3:
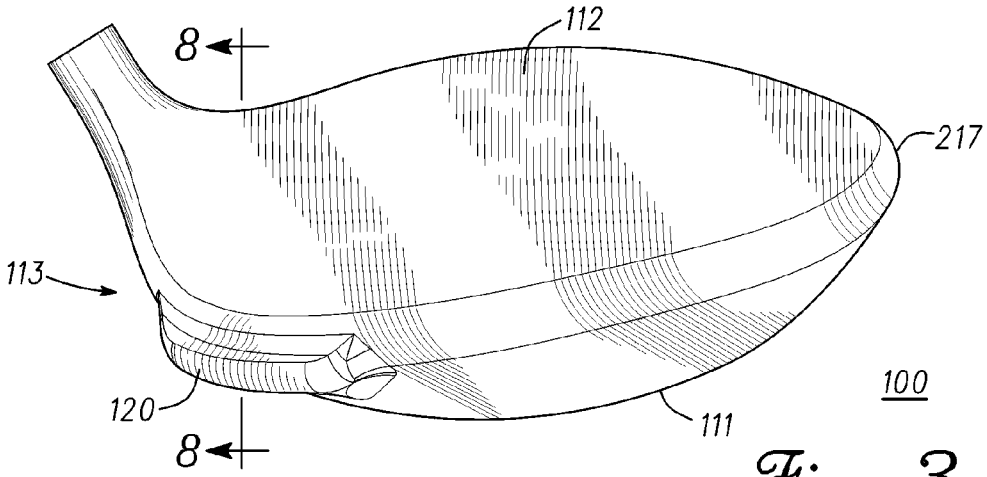
FIG. 3 illustrates a view of a rear potion of the golf club head of FIG. 1.
Figure 4:
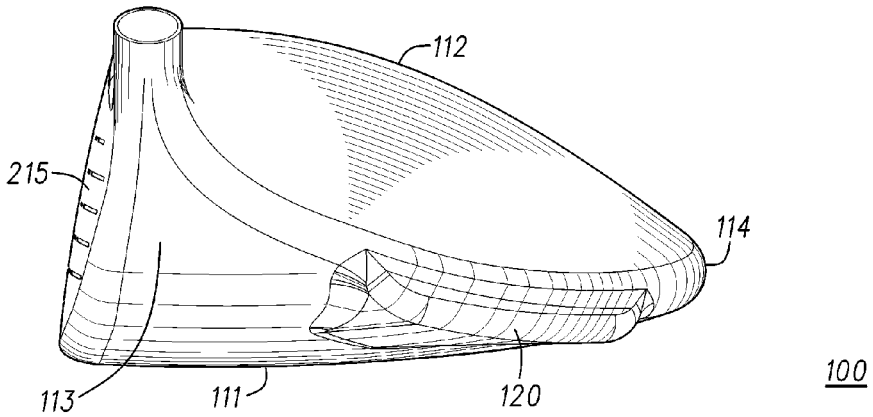
FIG. 4 illustrates a view of a heel portion of the golf club head of FIG. 1.
Figure 5:
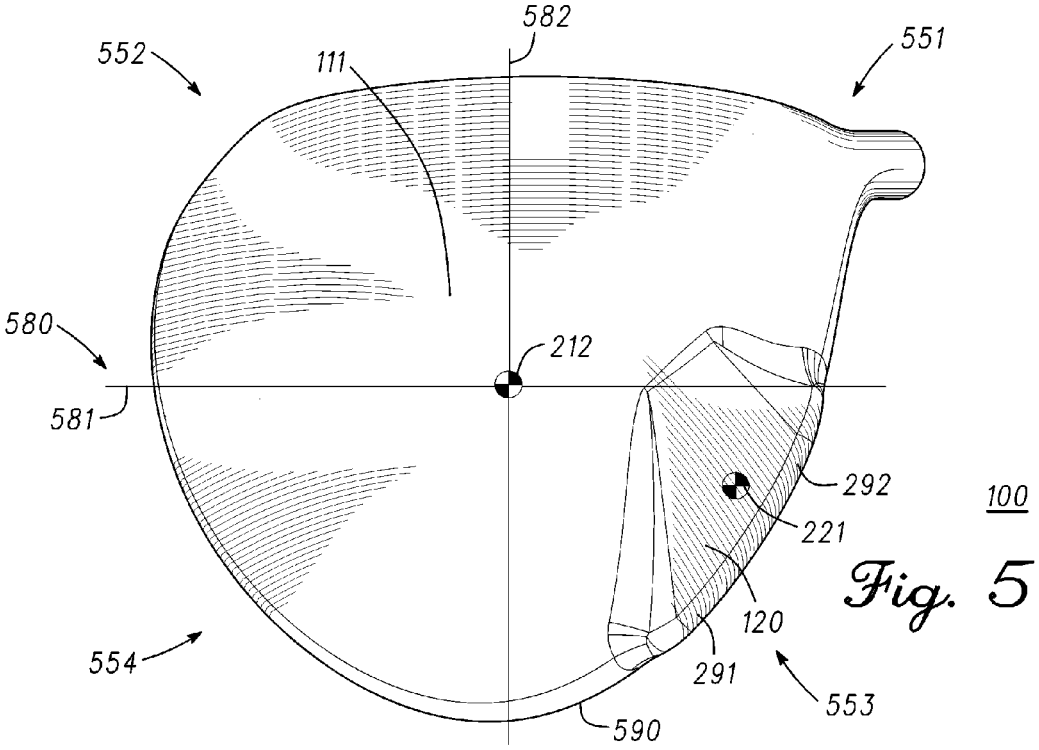
FIG. 5 illustrates a view of a sole portion of the golf club head of FIG. 1.
Figure 6:
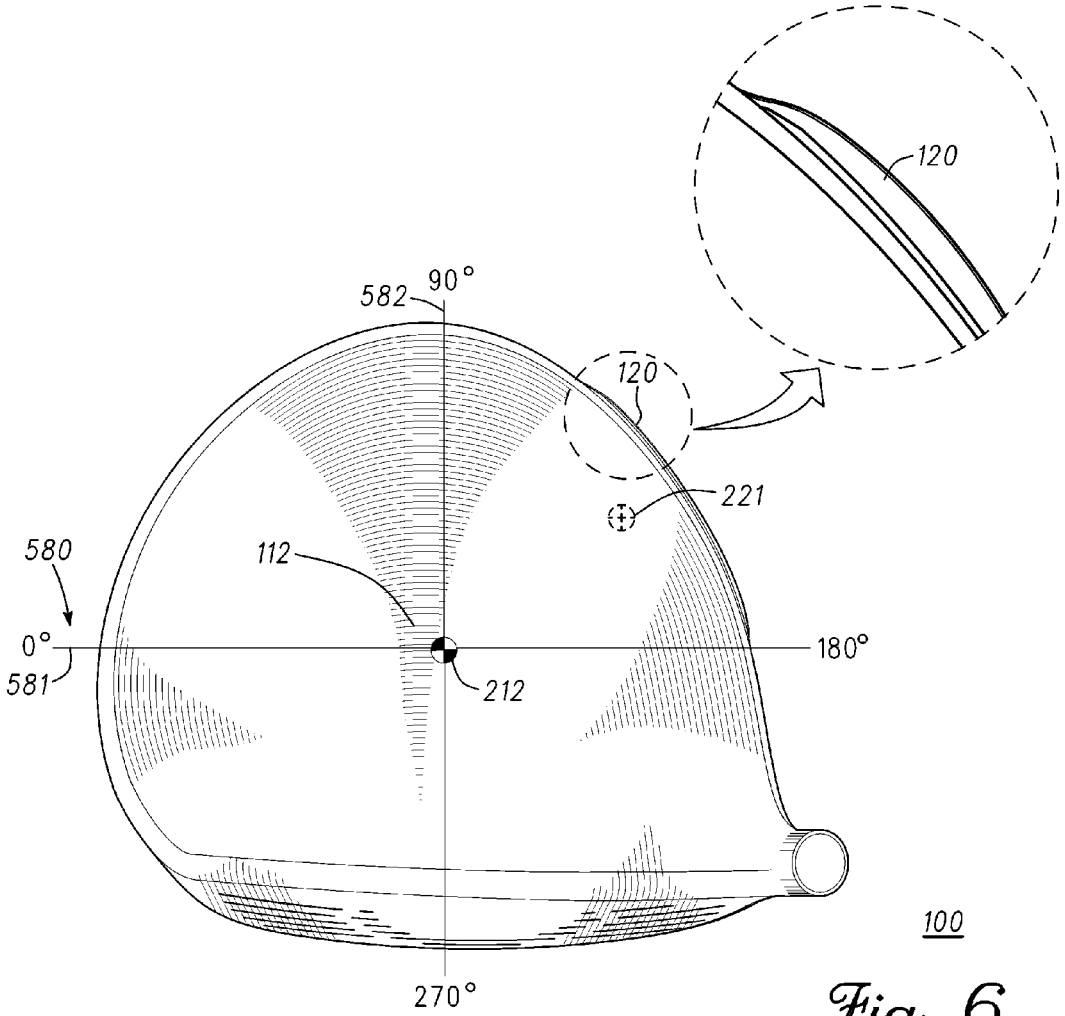
FIG. 6 illustrates a view of a crown portion of the golf club head of FIG. 1.
Figure 7:
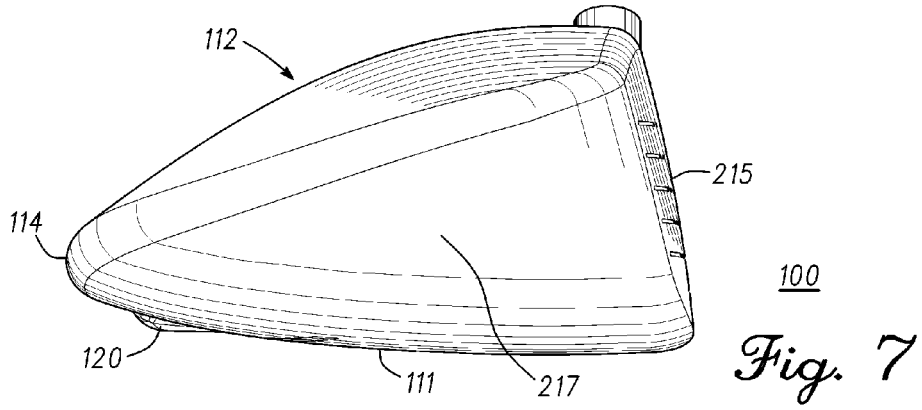
FIG. 7 illustrates a view of a toe portion of the golf club head of FIG. 1.
Figure 8:
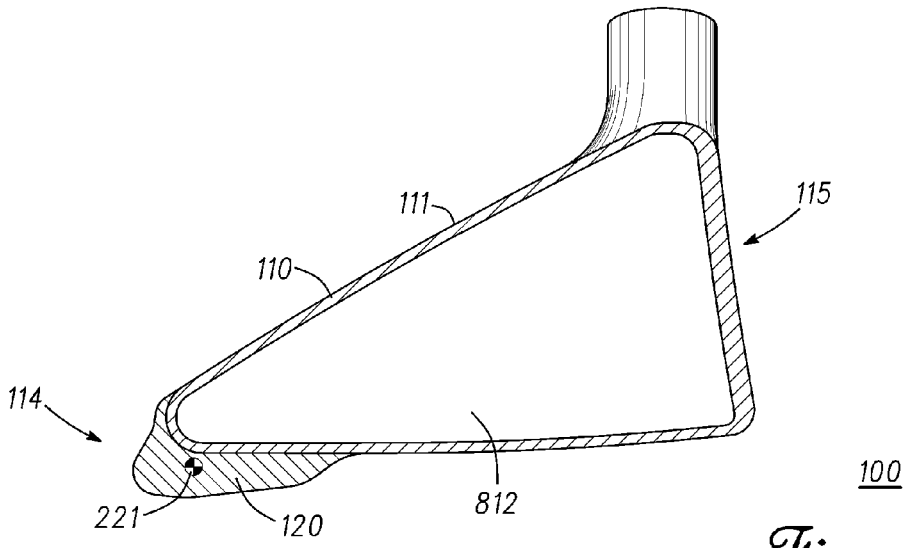
FIG. 8 illustrates a cross-sectional view of the golf club head of FIG. 1 cut across line 8-8 of FIG. 3.
Figure 9:
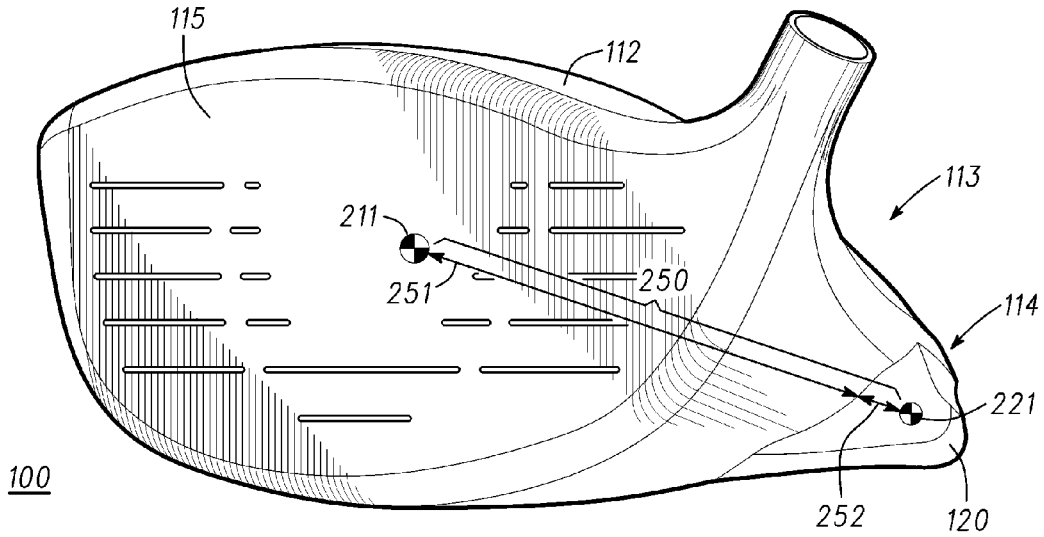
FIG. 9 illustrates a front-heel perspective view of the golf club head having the protruding weight of FIG. 1.

Turning now to the figures, FIG. 1 illustrates a rear-heel perspective view of golf club head 100 comprising protruding weight 120. To highlight the features of protruding weight 120 in the present example, golf club head 100 is shown inverted, and protruding weight 120 is highlighted in a wire-frame rendition. FIG. 2 illustrates a view of front portion 115 of golf club head 100. FIG. 3 illustrates a view of rear potion 114 of golf club head 100. FIG. 4 illustrates a view of heel portion 113 of golf club head 100. FIG. 5 illustrates a view of sole portion 111 of golf club head 100. FIG. 6 illustrates a view of crown portion 112 of golf club head 100. FIG. 7 illustrates a view of toe portion 217 of golf club head 100. FIG. 8 illustrates a cross-sectional view of golf club head 100 cut across line 8-8 of FIG. 3, as seen from the perspective of toe portion 217 in FIG. 7. FIG. 9 illustrates front-heel perspective view of golf club head 100 having protruding weight 120.

In the embodiment of FIGS. 1-7, golf club head 100 comprises body 110 with crown portion 112, heel portion 113, toe portion 217, rear portion 114, and front portion 115. Also in the present embodiment, body 110 comprises hosel portion 116, sole portion 111, and skirt portion 117 located between sole portion 111 and crown portion 112. Club head 100 also comprises protrusion weight 120 protruded from body 110 at heel portion 113, skirt portion 117, and sole portion 111.

There can be other embodiments, however, with club heads similar to club head 100, but that do not comprise one or more of a skirt portion or a hosel portion as illustrated for club head 100. In addition, although in the present embodiment club head 100 comprises a driver head, there can be other embodiments comprising other types of club heads such as fairway woods, hybrids, and/or or other suitable types of club heads comprising protrusion weights similar to protrusion weight 120. There also can be other embodiments where protrusion weight 120 may protrude from other portions of body 110. For example, protrusion weight 120 may protrude from skirt portion 117 and not from sole portion 111, or vice-versa. In another example, at least a portion of a protrusion weight similar to protrusion weight 120 may protrude from one or more of the other portions described above for club head 100.

Body 110 encompasses body volume 812, as illustrated in the cross-section of FIG. 8 for the present embodiment. Although in the present embodiment body volume 812 is hollow, there may be other embodiments comprising a body volume that is solid, or where at least portions thereof are solid. Body volume 812 can comprise between approximately 400 cc (cubic centimeters) to approximately 470 cc, but could comprise other volumes based on the type of club head to which it belongs. For instance, in one example comprising a driver head, the corresponding body volume can range to approximately 600 cc. In another example comprising a fairway wood head, the corresponding body volume could comprise between approximately 130 cc to approximately 250 cc. As shown in FIG. 8, protrusion weight 120 is configured in the present embodiment to be external to body volume 812 of body 110. In addition, center of gravity 221 of protrusion weight 120 is also external to body volume 812 in the present embodiment. In the present example shown in FIG. 1, sidewall 118 of body 110 is integral with surface 128 of protrusion weight 120 while still protruding externally from a contour body 110. There also can be embodiments, however, where protrusion weight 120 can be entirely external to sidewall 118 of body 110 of club head 100. For example, surface 128 of protrusion weight 120 could be non-integral or separate from sidewall 118 of body 110 in other embodiments, and could be coupled thereto via glue, screws, welding, and/or or other mechanical fastening mechanisms. In the same or different examples, sidewall 118 of body 110 is either separable or inseparable from surface 128 of protrusion weight 120.

Configuring protrusion weight 120, or center of gravity 221 thereof, to be external to body volume 812 can provide several benefits with respect to several characteristics of club head 100. For instance, a moment of inertia of club head 100 may be increased as a result of an extension in distance 250 between center of gravity 221 of protrusion weight 120 and center of gravity 211 of club head 100. As an example, as shown in FIGS. 2 and 8, distance 250 has been extended by distance extension 252 between body 110 and center of gravity 221 of protrusion weight 120. In contrast, other embodiments having only weighting internal to body 110 would be limited to an internal distance, such as internal distance 251, as the maximum distance with which to affect the moment of inertia of club head 100. In some examples, club heads comprising protrusion weights similar to protrusion weight 120 may comprise moments of inertia of approximately 4000 $g \cdot cm^2$ (gram·square centimeter) to approximately 6000 $g \cdot cm^2$ about a vertical axis (similar to axis 290 in FIG. 2) through their respective centers of gravity, and/or their respective moments of inertia could be increased by approximately 10% to approximately 20% due to the incorporation of the protrusion weight. In other examples, club heads such as fairway wood heads comprising protrusion weights similar to protrusion weight 120 may comprise moments of inertia of approximately 2500 $g \cdot cm^2$ to approximately 3500 $g \cdot cm^2$ about a vertical axis (similar to axis 290 in FIG. 2) through their respective centers of gravity, and/or their respective moments of inertia could be increased by approximately 4% to approximately 8% due to the incorporation of the protrusion weight.

In the present embodiment, assuming that club head 100 rotates about center of gravity 211 during impact, the moment of inertia I of club head 100 can be adjusted via the following equation:

$$I=md^2$$

where m corresponds to a mass of protrusion weight 120, and d corresponds to distance 250. Therefore, because distance extension 252 increases distance 250 further than would be possible if protrusion weight 120 were located within body volume 812, moment of inertia I of club head 100 can be thereby increased without having to resort to increasing mass m of an internal weight. This technique can be beneficial, for example, in situations where the mass of club head 100 is constrained by regulations prescribing a maximum golf club head mass and/or in situations where additional golf club head mass could affect or interfere with a golfer's swing. Furthermore, in light of the equation above, because the effect of distance d is squared with respect to moment of inertia I, compared to the effect of mass m, which is only linear, adjusting the moment of inertia of club head 100 via distance extension 252 is more efficient than attempting to adjust it by altering the mass of weighting within body volume 812.

In examples such as the present one, the ability to place protrusion weight outside of sidewall 118 of body 110 can be beneficial, for example, to provide, shape, and/or locate a mass of protrusion weight 120 as needed, without being constrained by dimensions or characteristics of body volume 812. For example, a mass of protrusion weight 120 can comprise between approximately 7% to approximately 16% of a total mass of club head 100 in some embodiments. In the same or other embodiments, the mass of protrusion weight 120 can comprise between approximately 15 grams to approximately 30 grams, and/or the mass of club head 100 can comprise between approximately 190 grams to approximately 210 grams.

In another example, a club head such as fairway wood head may comprise a mass of between approximately 200 grams to approximately 240 grams, with a protrusion weight similar to protrusion weight 120 ranging between approximately 10 grams to approximately 30 grams. In the same or other examples, the mass of the protrusion weight can comprise between approximately 3% to approximately 10% of the total mass of the club head.

In the present embodiment of club head 100, center of gravity 211 of club head 100 is located toward heel portion 113 of body 110, shifted by protrusion weight 221 away from toe portion 217. Toe portion 217 extends toe-wards from geometric center 212, while heel portion 113 extends heel-wards from geometric center 212 in the present example. In the present embodiment, protrusion weight 120 shifts center of gravity 211 of club head 100 towards heel portion 113, towards sole portion 110, and towards rear portion 114. In the same or other embodiments, protrusion weight 120, may shift center of gravity 211 of club head 100 by approximately 1.25 mm to approximately 5.1 mm towards heel portion 113, and/or by approximately 7.6 mm to approximately 12.7 mm towards rear portion 114. In the same or other embodiments, center of gravity 211 of club head 100 can be shifted by protrusion weight 120 away from center of gravity 213 of body 110 and/or away from geometric center 212 of body 110. There can be examples, geometric center 212 may comprise and/or coincide with a volumetric center of body 110. In another embodiment comprising a fairway wood head, a protrusion weight similar to protrusion weight 120 may shift a center of gravity of the fairway wood head by approximately 1.6 mm to approximately 2.0 mm towards the heel portion of the fairway wood head, and/or by approximately 1.4 mm to approximately 1.7 mm towards the rear portion of the fairway wood head.

As will be further described below, the shifting of center of gravity 211 of club head 100, as caused by protrusion weight 221, can provide several benefits to improve a user's swing, such as aiding in the correction of a user's tendency to hit slice shots. In the present embodiment, club head 100 is devoid of a toe weight member at toe portion 217, where such toe weight member could be counteractive to the shift of center of gravity 211 by protrusion weight 120.

In addition, as seen from FIGS. 1-8, protrusion weight 120 is visible from an exterior of club head 100, such as from the address position perspective illustrated in FIG. 6. Such arrangement with respect to visibility may have an additional benefit of increasing user confidence for users that can appreciate the enhanced control and performance features that the external positioning of protrusion weight 120 can provide. The arrangement of the present embodiment also permits protrusion weight 120 to be shaped such as to not significantly alter the overall appearance and/or structure of club head 100 as compared to customary club heads of the same category. As an example, body volume 812 can be considered as subdivided into a heel portion volume towards heel portion 113, and into a toe portion volume towards toe portion 217, where the heel and toe portion volumes can be configured to be within approximately 20% of each other to maintain symmetry and thereby preserve the overall appearance and structure of club head 100 with respect to customary club heads. In the same or other examples, the heel and toe portion volumes can be configured to be within approximately 10% of each other. In some examples, customary club heads may have a symmetrical pear, triangular, c-shaped, and/or square shape that can be substantially preserved even with the addition. As a result, body volume 812 and/or sidewall 118 of club head 100 do not have to be significantly altered into aesthetically unpleasing and/or structurally unsound shapes that could negatively affect ball launch speed or trajectory characteristics in order to achieve the degree of center of gravity shifting that protrusion weight 120 allows in the present example for center of gravity 211.

To facilitate the description herein, club head 100 can be subdivided into four quadrants about geometric center 212, as shown in FIG. 5 for front-heel quadrant 551, front-toe quadrant 552, rear-heel quadrant 553, and rear-toe quadrant 554. In such an arrangement, center of gravity 221 of protrusion weight 120 can be located at rear-heel quadrant 553, as shown in FIG. 5, even if part of protrusion weight 120 extends into one or more of the other quadrants. In addition, as seen in FIG. 6, club head 100 can be referenced with respect to compass plane 580 centered about geometric center 212 of body 110 and defined by heel-to-toe axis 581 and front-to-rear axis 582, where the toe-end of heel-to-toe axis 581 is at zero degrees, and where angles of compass plane 580 increase in a clockwise manner with respect to the address position perspective of FIG. 6 such that the 90-degree mark of compass plane 580 is at the rear end of front-to-rear axis 582. In the present embodiment of club head 100, with reference to the address position shown in FIG. 6, center of gravity 221 of protrusion weight 120 can be located between approximately 120 degrees and approximately 180 degrees with respect to compass plane 580. More specifically, center of gravity 221 can be located at approximately 135 degrees with respect to compass plane 580, although other locations could be suitable in other embodiments.

Depending on the intended club head effects or characteristics, however, there also can be embodiments where center of gravity 221 can be located at or between other quadrants besides rear-heel quadrant 553 in FIG. 5, and/or at or between other angles or ranges of angles other than the approximately 120 degree to approximately 180 degree range described above with respect to compass plane 580.

Figure 13:
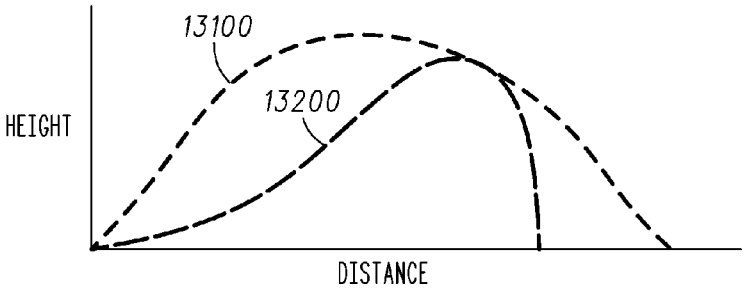
FIG. 13 illustrates a comparison of a first flightpath comprising a higher launch angle and a lower launch spin, relative to a second flightpath comprising a lower launch angle and a higher launch spin.

In the present embodiment, protrusion weight 120 is separate from hosel portion 116 at front-heel quadrant 551, such as to maintain the location of center of gravity 221 of protrusion weight 120 at rear-heel quadrant 553. Such location separate from hosel portion 116 can be beneficial, for example, to maintain center of gravity 211 of club head 100 distanced from front portion 115 of body 110. In the same or other examples, maintaining or shifting center of gravity 211 towards rear portion 114 and/or towards sole portion 111, as accomplished by protrusion weight 120, can allow for improved launch characteristics. Such improved launch characteristics can comprise higher launch angles and/or lower launch spin, which can lead to more optimal trajectories and greater distances when club head 100 impacts a golf ball. FIG. 13 illustrates a comparison of flightpath 13100, comprising the improved launch characteristics of higher launch angle and lower launch spin, relative to flightpath 13200 comprising a lower launch angle with higher launch spin.

Figure 10:
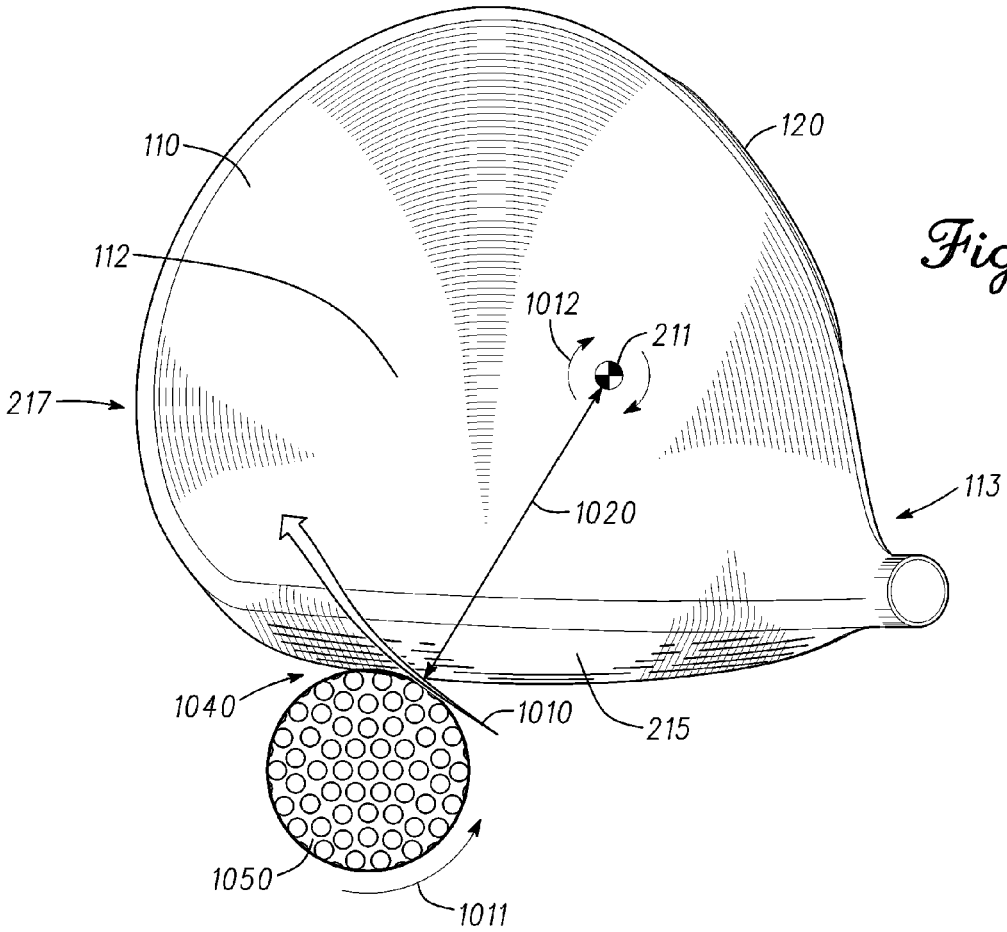
FIG. 10 illustrates an image of the golf club head of FIG. 1 upon impact between a toe portion of a club face thereof and a ball.
Figure 11:
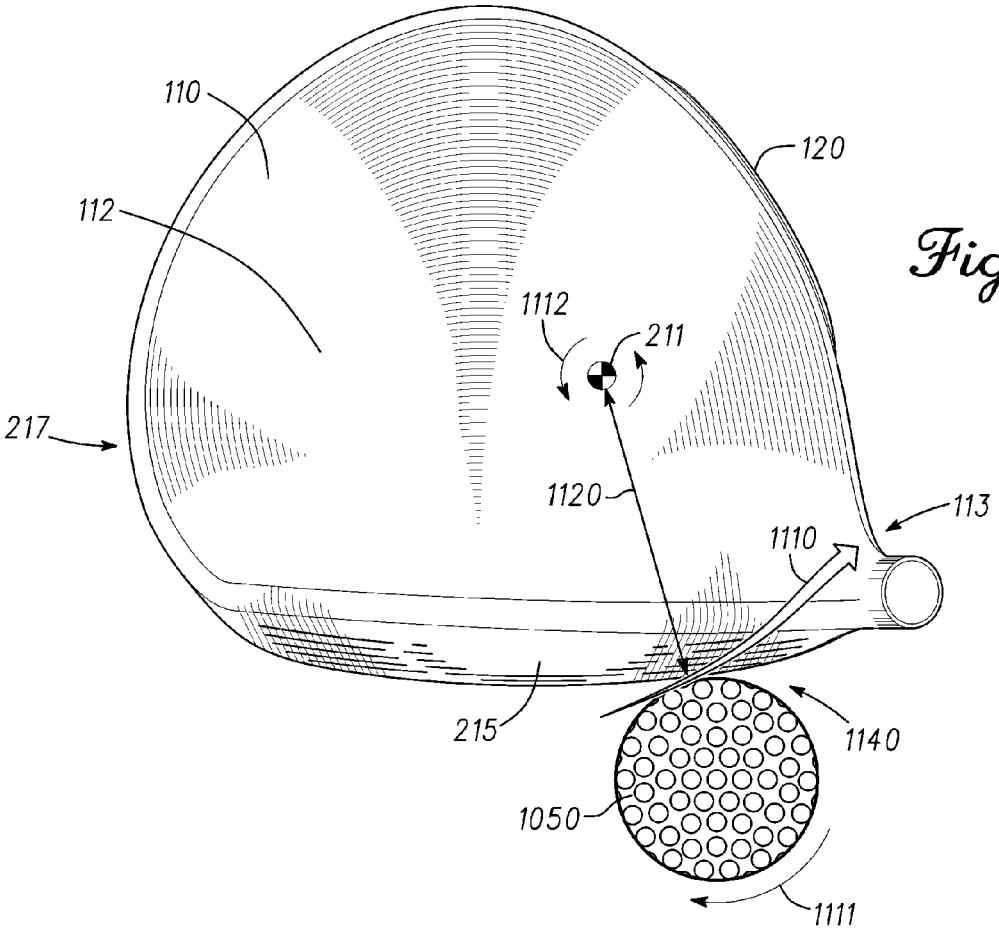
FIG. 11 illustrates an image of the club head of FIG. 1 upon impact between a heel portion of the club face thereof and the ball.

Weight 210 is also positioned such as to shift center of gravity 211 of club head 100 towards heel portion 113 and towards rear portion 114 in the present embodiment. Such configuration can be beneficial, as seen in the exemplary situations of FIGS. 10-11, to affect a gear effect resulting from impact between club face 215 and golf ball 1050. FIG. 10 illustrates an image of club head 100 upon impact between ball 1050 and club face 215 towards toe portion 217. FIG. 11 illustrates an image of club head 100 upon impact between ball 1050 and club face 215 towards heel portion 113.

With respect to the illustration of FIG. 10, protrusion weight 120 is configured to impart increased hook spin 1011 onto ball 1050 when club face 215 impacts ball 1050 at impact point 1040 towards toe portion 217. In the present example, because of the shifting of center of gravity 211 of club head 100 towards heel portion 113, afforded by distance extension 252 as described above with respect to FIGS. 2 and 9, distance 1020 between center of gravity 211 and impact point 1040 is increased. Such increase in distance 1020 can generate an augmented gear effect 1010 between club face 215 and ball 1050, when club head 100 undergoes rotation 1012 about center of gravity 211 upon impact with ball 1050 at impact point 1040, and can thereby impart further increased hook spin 1011 onto ball 1050 than would otherwise be possible if protrusion weight 120 were internal to body volume 812 (FIG. 8). In the same or other examples, because center of gravity 211 of club head 100 is at heel portion 113, increased hook spin 1010 may still be imparted onto ball 1050 even if impact point 1040 were located at a center of club face 215.

With respect to the illustration of FIG. 11, protrusion weight 120 is configured to impart decreased slice spin 1111 onto ball 1050 when club face 215 impacts ball 1050 at impact point 1140 towards heel portion 113. In the present example, because of the shifting of center of gravity 211 of club head 100 towards heel portion 113, afforded by distance extension 252 as described above with respect to FIGS. 2 and 9, distance 1120 between center of gravity 211 and impact point 1140 is decreased. Such decrease in distance 1120 can generate a decreased gear effect 1110 between club face 215 and ball 1050, when club head 100 undergoes rotation 1112 about center of gravity 211 upon impact with ball 1050 at impact point 1140, and can thereby impart further decreased slice spin 1111 onto ball 1050 than would otherwise be possible if protrusion weight 120 were internal to body volume 812 (FIG. 8).

The effects described above with respect to gear effects 1010 (FIG. 10) and/or 1110 (FIG. 11) as made possible and/or as adjusted by protrusion weight 120 and extended distance 252 (FIG. 2), can be beneficial for users who struggle with a tendency to hit slice shots, by imparting increased hook spin 1011 (FIG. 10) and/or decreased slice spin 1111 (FIG. 11). In addition, because center of gravity 211 is shifted by protrusion weight 120 to be closer to hosel 116, the angular force required to turn or twist club head 100 during a swing can be reduced, thereby allowing users to square club face 215 with ball 1050 more easily for straighter shots.

In the present embodiment of FIG. 5, a portion of protrusion weight 120 is located at edge 590 of club head 100, where edge 590 lies between crown portion 112 and sole portion 110. In addition, as seen in FIG. 5, center of gravity 221 of protrusion weight 120 is located in rear-heel quadrant 553 between points 291 and 292. Point 291 represents a location where further shifting of protrusion weight along edge 590 towards rear portion 114 would shift center of gravity 211 of club head 100 more towards toe portion 217 than towards rear portion 114. Similarly, point 292 represents a location where further shifting of protrusion weight along edge 590 towards heel portion 113 would shift center of gravity 211 of club head 100 more towards front portion 115 than towards heel portion 113. In some examples, points 291 and 292 may comprise substantially the same point along edge 590. There can be other embodiments, however, where protrusion weight 120 may be positioned elsewhere at or relative to body 110 to counteract other tendencies, such as a tendency to hit hook shots.

Figure 12:
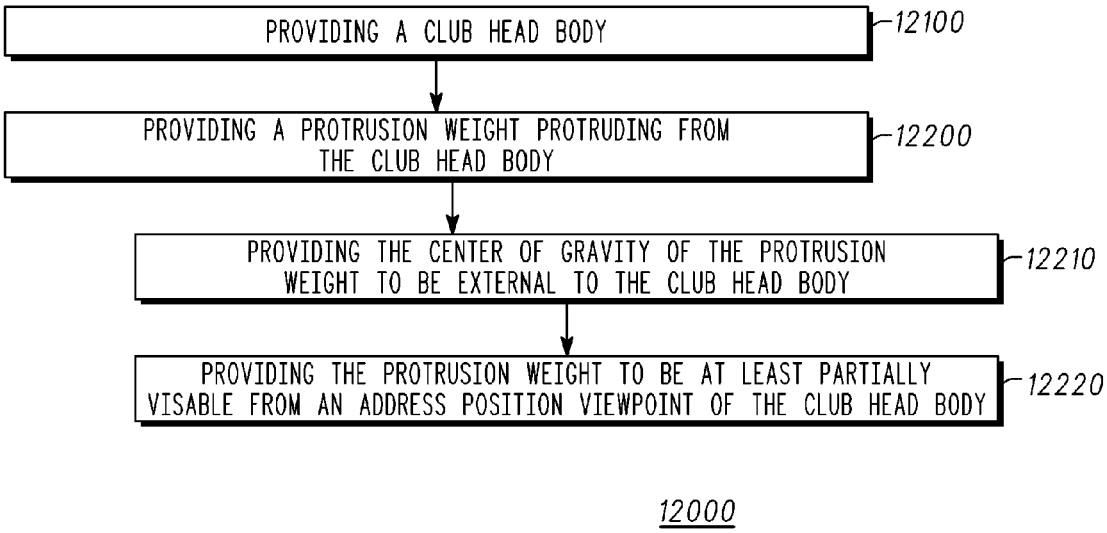
FIG. 12 illustrates a flowchart of method for providing a club head in accordance with the present disclosure.

Moving along, FIG. 12 illustrates a flowchart of method 12000 for providing a club head. In some embodiments, the club head of method 12000 can be similar to club head 100 as described above with respect to FIGS. 1-11. In the same or other examples, the club head can comprise a driver club head, an iron club head, a fairway wood head, a hybrid head, or a putter head, among others.

Block 12100 of method 12000 comprises providing a club head body. In some examples, the club head body can be similar to body 110 of club head 100 in FIGS. 1-11. In the same or other examples, the club head body may be referenced with respect to one or more quadrants, such as front-heel quadrant 551, front-toe quadrant 552, rear-heel quadrant 553, and/or rear-toe quadrant 554 as shown in FIG. 5. In the same or other examples, the club head body may be referenced with respect to a compass plane similar to that described above for compass plane 580 (FIGS. 5-6).

The club head body can comprise a volume that may be fully or partially hollow or solid, depending on the implementation, similar to body volume 812 (FIG. 8). The club head body can also comprise and/or be shaped or defined by a sidewall such as sidewall 118 (FIG. 1). The club head body may also comprise several portions that may be similar to portions described with respect to club head 100, such as crown portion 112, toe portion 217, heel portion 113, hosel portion 116, sole portion 111, and/or skirt portion 117, among others. There can be examples where the club head body may be provided to be substantially similar to or shaped like customary club heads of the same type. For example, the club head body may be shaped along the lines of a traditional driver head. In the same or other examples, the volume of the club head may comprise a heel portion volume and a toe portion volume, where the heel and toe portion volumes can be within approximately 20% of each other. In some examples, such arrangement can limit a shape of the club head so that it does not look disproportionately or substantially biased towards, for example, the heel portion of the club head relative to customary club heads.

Block 12200 of method 12000 comprises providing a protrusion weight protruding from the club head body. In some examples, the protrusion weight can be similar to protrusion weight 120 as described above with respect to club head 100 for FIGS. 1-11. In some examples, providing the protrusion weight in block 12200 can comprise providing the protrusion weight to protrude from the heel portion and from at least one of the sole portion or the skirt portion of the club head body of block 12100. For instance, the protrusion weight can protrude as shown in FIG. 5 from sole portion 111, skirt portion 117, and heel portion 113 at rear-heel quadrant 553. The protrusion weight can also be located to protrude as shown and described above for FIG. 6, such that, from an address position viewpoint, where a toe end of the heel-to-toe axis is located at zero degrees with respect to the compass plane and the geometric center of the club head body, the center of gravity of the protrusion weight is located between approximately 120 degrees and approximately 180 degrees.

In the same or other examples, a center of gravity of the club head may be located at a heel portion of the club head body, shifted by the protrusion weight away from a center of gravity of the body and/or away from a geometric center of the body, as described above for FIG. 2 with respect to center of gravity 211 of club head 100.

There can be examples where providing the club head body in block 12100 can comprise providing an external surface of the club head body to be integral, inseparable, and/or continuous with an external surface of the protrusion weight, such as seen in FIG. 1 with respect to sidewall 118 of club head body 110 and the exterior surface of protrusion weight 120. In other examples, providing the protrusion weight in block 12200 may comprise keeping the protrusion weight separate, separable and/or non-integral with the hosel portion and/or the external surface of the club head body.

In the same or other examples, providing the club head body in block 12100 may comprise providing the club head to be devoid of a weight member at its toe portion, where such weight member could be counteractive of the protrusion weight's shift of the center of gravity of the club head towards the heel portion. In such examples, the weight member in the toe portion may or may not comprise a perimeter weight in the case of club heads like iron heads.

Block 12200 may also involve sub-block 12210 in some examples, comprising providing a center of gravity of the protrusion weight to be external to the club head body. In some examples, the center of gravity of the protrusion weight can be arranged as described above for center of gravity 221 of protrusion weight 120 (FIGS. 2, 5, 9) located outside of club head body 110, external to body volume 812 (FIG. 8) and/or external to sidewall 118 of club head body 110.

In the same or other examples, providing the center of gravity of the protrusion weight in accordance with block 12210 may permit a moment of inertia of the club head to be increased, for reasons similar to those described above with respect to club head 100, due the presence of a distance extension of a distance between the center of gravity of the protrusion weight and the center of gravity of the club head. In some examples, the distance extension may be external to body 110 and/or otherwise similar to distance extension 252 as described above with respect to distance 250 (FIG. 2) of club head 100.

There can also be examples where block 12200 can comprise sub-block 12220, comprising providing the protrusion weight to be visible from an exterior of the club head body. In some examples, the protrusion weight can be at least partially visible from an address position viewpoint, as shown in FIG. 6 for protrusion weight 120. As described above, such visibility may be beneficial for increasing user confidence for users that can appreciate the enhanced control and performance features that the external positioning of protrusion weight 120 can provide.

In terms of performance, providing the protrusion weight as described above with respect to block 12200 may cause the club head of method 12000 to impart an increased hook spin onto a golf ball upon impact at a toe side of a face of the club head. In some examples, the increased hook spin may result from an augmented gear effect between the club face and the golf ball due the presence of the distance extension. In the same or other examples, providing the protrusion weight may cause the club head of method 12000 to impart a decreased slice spin onto the golf ball upon impact at a heel-portion of the club face, the decreased spin resulting from an decreased gear effect between the club face and the golf ball due to the presence of the distance extension.

In some examples, some of the blocks of method 12000 can be subdivided into one or more sub-blocks. For example, block 12100 can be subdivided to comprise a sub-block for providing a club face for the club head body for embodiments where the club face is not integral with the club head body.

In the same or other examples, one or more of the different blocks of method 12000 can be combined into a single block or performed simultaneously, and/or the sequence of such blocks can be changed. For example, sub-blocks 12210 and 12220 of block 12200 can be performed simultaneously. In the same or other examples, blocks 12100 and 12200 can be performed simultaneously.

There can also be examples where method 12000 can comprise further or different blocks. As an example, method 12000 can also comprise a block for providing and/or attaching a golf club shaft to the body of the club head. Other variations can be implemented for method 2000 without departing from the scope of the present disclosure.

Although the club heads with protrusion weights and related methods have been described with reference to specific embodiments, various changes may be made without departing from the spirit or scope of the present disclosure. Examples of such options and other embodiments have been given in the foregoing description. Accordingly, the disclosure herein of embodiments of club heads with protrusion weights and related methods is intended to be illustrative of the scope of the present disclosure and is not intended to be limiting. For example, in one embodiment, a golf club head may have one or more features shown or described in one or more of FIGS. 1-11, with or without other features also shown or described with reference to FIGS. 1-11. As another example, club head 100 or similar clubs described herein may be part of a golf club head set, where each club of such golf club head set may comprises a protrusion weight in accordance with the description above of protrusion weight 120. Other permutations of the different embodiments having one or more of the features of the various figures are likewise contemplated. It is intended that the scope of the club heads with protrusion weights and related methods described herein shall be limited only to the extent required by the appended claims.

The club heads with protrusion weights and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment, and may disclose additional embodiments.

All elements claimed in any particular claim are essential to the club heads with protrusion weights and related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a head body comprising:

a crown portion, a sole portion, a heel portion with a heel end, a toe portion with a toe end, a rear portion, a front portion comprising a club face, and a geometric center;

and a protrusion weight coupled to the head body;

wherein:

the protrusion weight protrudes from at least the heel portion of the head body and is separated from the toe portion of the head body;

a head center of gravity of the golf club head is defined by both a mass of the head body and a mass of the protrusion weight;

a body center of gravity of the head body is defined by the mass of the head body independent of the mass of the protrusion weight;

a weight center of gravity of the protrusion weight is defined by the mass of the protrusion weight independent of the mass of the head body, and is external to a body volume of the head body of the golf club head; and the protrusion weight is at least partially visible from an exterior of the golf club head.

2. The golf club head of claim 1, wherein:

the protrusion weight is externally visible from an address position perspective.

3. The golf club head of claim 1, wherein:

a moment of inertia of the golf club head is increased due to a distance extension of a distance between the weight center of gravity of the protrusion weight and the head center of gravity of the golf club head; and the extended distance is external to the body volume.

4. The golf club head of claim 1, wherein:

the club face imparts an increased hook spin onto a golf ball upon impact at a toe-portion section of the club face; and the increased hook spin results from an increased gear effect between the toe-portion section of the club face and the golf ball due to a location of the weight center of gravity relative to the head body.

5. The golf club head of claim 1, wherein:

the club face imparts a decreased slice spin onto a golf ball upon impact at a heel-portion section of the club face, the decreased slice spin resulting from a decreased gear effect between heel-portion of the club face and the golf ball due to a location of the weight center of gravity relative to the head body.

6. The golf club head of claim 1, wherein:

the head center of gravity is shifted towards the heel portion by the weight center of gravity; and the golf club head is devoid of a weight member at the toe portion fully counteractive of the weight center of gravity's shift of the head center of gravity.

7. The golf club head of claim 1, wherein:

an exterior sidewall of the head body of the golf club head is integral with a surface of the protrusion weight.

8. The golf club head of claim 1, wherein:

the body volume comprises:

a heel portion volume between the geometric center and the heel end; and a toe portion volume between the geometric center and the toe end;

and the heel and toe portion volumes are within approximately 20% of each other.

9. The golf club head of claim 1, wherein:

the protrusion weight is separated from a hosel of the head body of the golf club head.

10. The golf club head of claim 1, wherein:

the protrusion weight is located at a rear-heel quadrant of the golf club head and towards an edge of the head body, between:

a first point where further shifting of the protrusion weight along the edge and towards the rear portion would shift the head center of gravity more towards the toe portion than towards the rear portion; and a second point where further shifting of the protrusion weight along the edge and towards the heel portion would shift the head center of gravity more towards the front portion than towards the heel portion.

11. A method for providing a golf club head, the method comprising:

providing a head body comprising:

a crown portion, a sole portion, a heel portion with a heel end, a toe portion with a toe end, a rear portion, a front portion comprising a club face, a hosel, and a geometric center;

providing a protrusion weight at the head body; and coupling a golf shaft to the hosel of the head body;

wherein:

the protrusion weight protrudes from at least the heel portion of the head body and is separated from the toe portion of the head body;

a head center of gravity of the golf club head is defined by both a mass of the head body and a mass of the protrusion weight;

a body center of gravity of the head body is defined by the mass of the head body independent of the mass of the protrusion weight;

a weight center of gravity of the protrusion weight is defined by the mass of the protrusion weight independent of the mass of the head body, and is external to a body volume of the head body of the golf club head;

the geometric center of the head body defines a center of a compass plane that, from a top view of the golf club head, comprises:

a heel-to-toe axis extending through the geometric center;

a front-to-rear axis extending through the geometric center; and a zero-degree position defined by a toe end of the heel-to-toe axis;

and providing the protrusion weight comprises:

locating the protrusion weight such that the weight center of gravity is between approximately 120 degrees and approximately 180 degrees with respect to the compass plane.

12. The method of claim 11, wherein:

providing the protrusion weight comprises:

locating the protrusion weight such that the weight center of gravity is between approximately 125 degrees and approximately 145 degrees with respect to the compass plane.

13. The method of claim 11, wherein:

the protrusion weight is externally visible from an address position perspective.

14. The method of claim 11, wherein:

providing the protrusion weight comprises:

increasing a moment of inertia of the golf club head due to a distance extension of a distance between the weight center of gravity of the protrusion weight and the head center of gravity of the golf club head;

and the extended distance is external to the body volume.

15. The method of claim 11, wherein:

the club face imparts an increased hook spin onto a golf ball upon impact at a toe-portion section of the club face; and the increased hook spin results from an increased gear effect between the toe-portion section of the club face and the golf ball due to a location of the weight center of gravity relative to the head body.

16. A golf club head comprising:

a head body comprising:

a crown portion, a sole portion, a heel portion with a heel end, a toe portion with a toe end, a rear portion, a front portion comprising a club face, a hosel, and a geometric center;

and a protrusion weight at the head body;

wherein:

the protrusion weight protrudes from at least the heel portion of the head body and is separated from the toe portion of the head body;

a head center of gravity of the golf club head is defined by both a mass of the head body and a mass of the protrusion weight;

a body center of gravity of the head body is defined by the mass of the head body independent of the mass of the protrusion weight;

a weight center of gravity of the protrusion weight is defined by the mass of the protrusion weight independent of the mass of the head body;

the protrusion weight is separated from the hosel of the head body;

the head center of gravity is located between the body center of gravity and the heel end, shifted thereto by the weight center of gravity; and a mass of the protrusion weight comprises approximately 3% to approximately 16% of a total mass of the golf club head.

17. The golf club head of claim 16, wherein:

the weight center of gravity is external to a body volume of the head body; and the protrusion weight is externally visible from an address position perspective.

18. The golf club head of claim 16, wherein:

the golf club head comprises:

a driver-head body defining the head body;

a vertical axis extending through the geometric center of the golf club head; and a club head mass of approximately 190 grams to approximately 210 grams;

a moment of inertia of the golf club head is approximately 4000 $g \cdot cm^2$ to approximately 6000 $g \cdot cm^2$ about the vertical axis;

the protrusion weight comprises:

a protrusion weight mass of approximately 15 grams to approximately 30 grams;

the head body comprises:

a body volume of approximately 400 cc to approximately 600 cc;

and the head center of gravity is shifted towards the heel portion by the protrusion weight by approximately 1.25 mm to approximately 5.1 mm.

19. The golf club head of claim 16, wherein:

the golf club head comprises:

at least one of a fairway-wood-head body or a hybrid-head body defining the head body;

a vertical axis extending through the geometric center of the golf club head; and a club head mass of approximately 200 grams to approximately 240 grams;

the moment of inertia of the golf club head is approximately 2500 $g \cdot cm^2$ to approximately 3500 $g \cdot cm^2$ about the vertical axis;

the protrusion weight comprises:

a protrusion weight mass of approximately 10 grams to approximately 30 grams;

the head body comprises:

a body volume of approximately 130 cc to approximately 250 cc;

and the head center of gravity is shifted towards the heel portion by the protrusion weight by approximately 1.6 mm to approximately 2 mm.

20. The golf club head of claim 16, wherein:

the protrusion weight is located at a rear-heel quadrant of the golf club head and towards an edge of the head body, between:

a first point where further shifting of the protrusion weight along the edge and towards the rear portion would shift the head center of gravity more towards the toe portion than towards the rear portion; and a second point where further shifting of the protrusion weight along the edge and towards the heel portion would shift the head center of gravity more towards the front portion than towards the heel portion.

* * * * *